US007097525B2

(12) United States Patent
Oda et al.

(10) Patent No.: US 7,097,525 B2
(45) Date of Patent: Aug. 29, 2006

(54) METHOD FOR MANUFACTURING SPARK PLUG USING BENDING PROCESS FOR EARTH ELECTRODE

(75) Inventors: Syushi Oda, Kuwana (JP); Shigeki Tamura, Inabe (JP)

(73) Assignee: Denso Corporation, Kariya (JP)

( * ) Notice: Subject to any disclaimer, the term of this patent is extended or adjusted under 35 U.S.C. 154(b) by 0 days.

(21) Appl. No.: 10/921,359

(22) Filed: Aug. 19, 2004

(65) Prior Publication Data

US 2005/0042965 A1 Feb. 24, 2005

(30) Foreign Application Priority Data

Aug. 19, 2003 (JP) ..... 2003-295299

(51) Int. Cl.
*H01T 21/02* (2006.01)

(52) U.S. Cl. ..... 445/7; 29/33 N

(58) Field of Classification Search ..... 445/2, 445/7, 63; 29/33 N
See application file for complete search history.

(56) References Cited

U.S. PATENT DOCUMENTS

2002/0034915 A1 3/2002 Nakatani
2004/0029480 A1 * 2/2004 Fujita et al. ..... 445/7

FOREIGN PATENT DOCUMENTS

| | | |
|---|---|---|
| JP | 2000-164320 | 6/2000 |
| JP | 2002-164149 | 6/2002 |
| WO | WO 200193389 A1 * | 12/2001 |

* cited by examiner

*Primary Examiner*—Joseph Williams
*Assistant Examiner*—Hana Sanei
(74) *Attorney, Agent, or Firm*—Nixon & Vanderhye P.C.

(57) ABSTRACT

A spark plug is provided after a provisional bending process, during which the earth electrode is provisionally bent at almost 90 degrees. The earth electrode, one of both ends is joined to a housing member, has first and second end-side surfaces located mutually back to back and a tip surface connecting both end-side surfaces. A noble metal chip is mounted on the first end-side surface. A bending punch is set, which has a first pressing surface to be fitted to the second end-side surface located and a second pressing surface to be fitted to a tip surface. The bending punch is first moved so that the second pressing surface comes in contact with the tip surface of the earth electrode, and then moved so that the first pressing surface presses the second end-side surface in the axial direction of the center electrode. Accordingly, a main bending process is performed.

12 Claims, 5 Drawing Sheets

METHOD FOR MANUFACTURING SPARK PLUG USING BENDING PROCESS FOR EARTH ELECTRODE

BACKGROUND OF THE INVENTION

1. Technical Field

The present invention relates to a method of manufacturing spark plugs attached to an internal combustion engine mounted on an automobile.

2. Related Art

In an internal combustion engine, spark plugs are mounted to start the engine. The conventional spark plug is provided with a pillar-like center electrode held in an insulation manner within a housing member and an earth electrode one end of which is joined to the housing. The earth electrode is bent at its intermediate predetermined portion so as to make its other end (free end) face a tip of the center electrode. On the other end of the earth electrode, there is formed a noble metal chip. Thus ending the earth electrode is made to form a predetermined-size space, called "spark gap," between the noble metal chip and the tip of the center electrode.

How to manufacture the spark plug is proposed by, for example, Japanese Patent First Publication No. 2002-164149. This publication shows a technique of measuring various positions, such as the position of the tip of the center electrode, before bending the earth electrode. The measured results are then used to determine an amount of bending which allow the size of the spark gap to fall into a predetermined tolerance range assigned thereto.

However, in the case of the above conventional bending technique, it is difficult to control, with precision, the position of the other end of the earth electrode in a lateral direction perpendicular to an axial line passing through the center electrode. This means that the above simple bending technique is always involved in positional fluctuations of the tip end (the other end) of the earth electrode in the lateral direction. Such fluctuations are directly reflected in the position of the noble metal chip in the lateral direction.

As a result, in the spark plug in which the noble metal tip is bonded on the earth electrode, the coaxiality between the center electrode and the noble metal chip is decreased, which is one of the reasons that ignitionability of spark plugs lowers.

SUMMARY OF THE INVENTION

The present invention has been made with due consideration to the foregoing difficulty, and an object of the present invention is to raise accuracy in the coaxiality between the center electrode and the noble metal chip, in cases where the noble metal chip is boned on the other end of the earth electrode.

In order to achieve the object, there is provided a method for manufacturing a spark plug provided with a housing, a substantially cylindrical center electrode is held in a insulated manner in the housing, an earth electrode having both ends one of which is joined to the housing, and a noble metal chip joined on a first end-side surface of the other end of the earth electrode. The manufacturing method comprise steps of: providing the spark plug in a condition in which the earth electrode is bent through a provisional bending process so that the other end of the earth electrode is located closer to a tip of the center electrode than a condition in which the earth electrode is straight and in parallel with an axial line of the center electrode, the provided spark plug being mounted to a holder; setting a bending punch having a first pressing surface to be fitted to a second end-side surface located back-to-back to the first end-side surface and a second pressing surface to be fitted to a tip surface connecting the first and second end-side surfaces; moving the bending punch so that the second pressing surface comes in contact with the tip surface of the earth electrode; and second moving the bending punch so that the first pressing surface presses the second end-side surface in the axial direction of the center electrode, whereby a main bending process is performed to coaxially make the noble metal chip oppose to the tip of the center electrode via a spark gap of a predetermined length.

During the above main bending process, the bending punch is moved in the two-stage fashion to create a spark gap of a predetermined length. In this main bending process, the bent earth electrode is pressed, for example, downward in the axial direction of the center electrode. This pressing operation determines the dimension of the spark gap between the noble metal tip and the tip of the center electrode, but involves a lateral movement of the other end, i.e., the metal noble chip thereon, of the earth electrode in the lateral direction perpendicular to the axial direction of the center electrode. However, this lateral movement is limited by the second pressing surface formed on the bending punch. That is, the second pressing surface prohibits the noble metal chip from moving beyond the tip of the center electrode in the lateral direction during the pressing operation, whereby the noble metal chip is always kept to be located above the tip of the center electrode. In consequence, the spark gap that has undergone the main bending process is higher in the coaxiality between the noble metal chip and the center electrode, in addition to having a predetermined dimension.

It is preferred that the foregoing manufacturing method still comprises step of deciding a target position of the second pressing surface of the bending punch in a direction perpendicular to the axial line of the center electrode on the base of a distance from the tip surface of the earth electrode to the noble metal chip, wherein the first moving step moves the bending punch so that the second pressing surface comes in contact with the tip surface of the earth electrode on the basis of the decided target position.

It is also preferred that the foregoing manufacturing method still comprises steps of third moving at least one of the bending punch and the holder in a direction perpendicular to the axial line of the center electrode so as to separate the second pressing surface of the bending punch from the tip surface of the earth electrode after the main bending process; and fourth moving the bending punch along the axial line of the center electrode after the third moving step.

Another mode of the manufacturing method according to the present invention, there is a method for manufacturing a spark plug provided with a housing, a substantially cylindrical center electrode is held in a insulated manner in the housing, an earth electrode having both ends one of which is joined to the housing, and a noble metal chip joined on a first end-side surface of the other end of the earth electrode, comprising: providing the spark plug in a condition in which the earth electrode is bent through a provisional bending process so that the other end of the earth electrode is located closer to a tip of the center electrode than a condition in which the earth electrode is straight and in parallel with an axial line of the center electrode, the provided spark plug being mounted to a holder; bending the earth electrode so that a position of the other end of the earth electrode is changed for a main bending process for coaxially making the noble metal chip oppose to the tip of the center electrode via a spark gap of a predetermined length; measuring a coaxiality between the center electrode and the noble metal chip after the main bending process; and correcting a position of the noble metal chip in a direction perpendicular to the axial line of the center electrode on the basis of a result measured in the measuring step.

Preferably, in the provisional bending process, the earth electrode is bent at an angle of approximately 90 degrees, but less than 90 degrees.

As another aspect of the present invention, an apparatus for manufacturing a spark plug is provided. The spark plug is provided with a housing, a substantially cylindrical center electrode is held in a insulated manner in the housing, an earth electrode having both ends one of which is joined to the housing, and a noble metal chip joined on a first end-side surface of the other end of the earth electrode, wherein the spark plug is provided to the manufacturing apparatus in a condition in which the earth electrode is bent through a provisional bending process so that the other end of the earth electrode is located closer to a tip of the center electrode than a condition in which the earth electrode is straight and in parallel with an axial line of the center electrode. The manufacturing apparatus comprises: a holder holding the spark plug provided after the provisional bending process; a bending punch having a first pressing surface to be fitted to a second end-side surface located back-to-back to the first end-side surface and a second pressing surface to be fitted to a tip surface connecting the first and second end-side surfaces; a first driving unit driving the bending punch so as to move the bending punch in a direction along the axial line of the center electrode; a second driving unit driving at least one of the bending punch and the holder in a direction perpendicular to the axial line of the center electrode; and a bending controlling unit controlling the first and second driving units to perform a main bending process for coaxially making the noble metal chip oppose to the tip of the center electrode via a spark gap of a predetermined length.

Like the foregoing manufacturing method, the present manufacturing apparatus is able to have the identical operations and advantages to those described.

Various other configurations and advantages thereof will be made clear in the accompanying drawings and the descriptions in the embodiments.

DETAILED DESCRIPTION OF PREFERRED EMBODIMENTS

In connection with FIGS. 1 to 5, a preferred embodiment according to the present invention will now be described, in which a method and apparatus for manufacturing spark plugs are reduced into practice.

Figure 1:
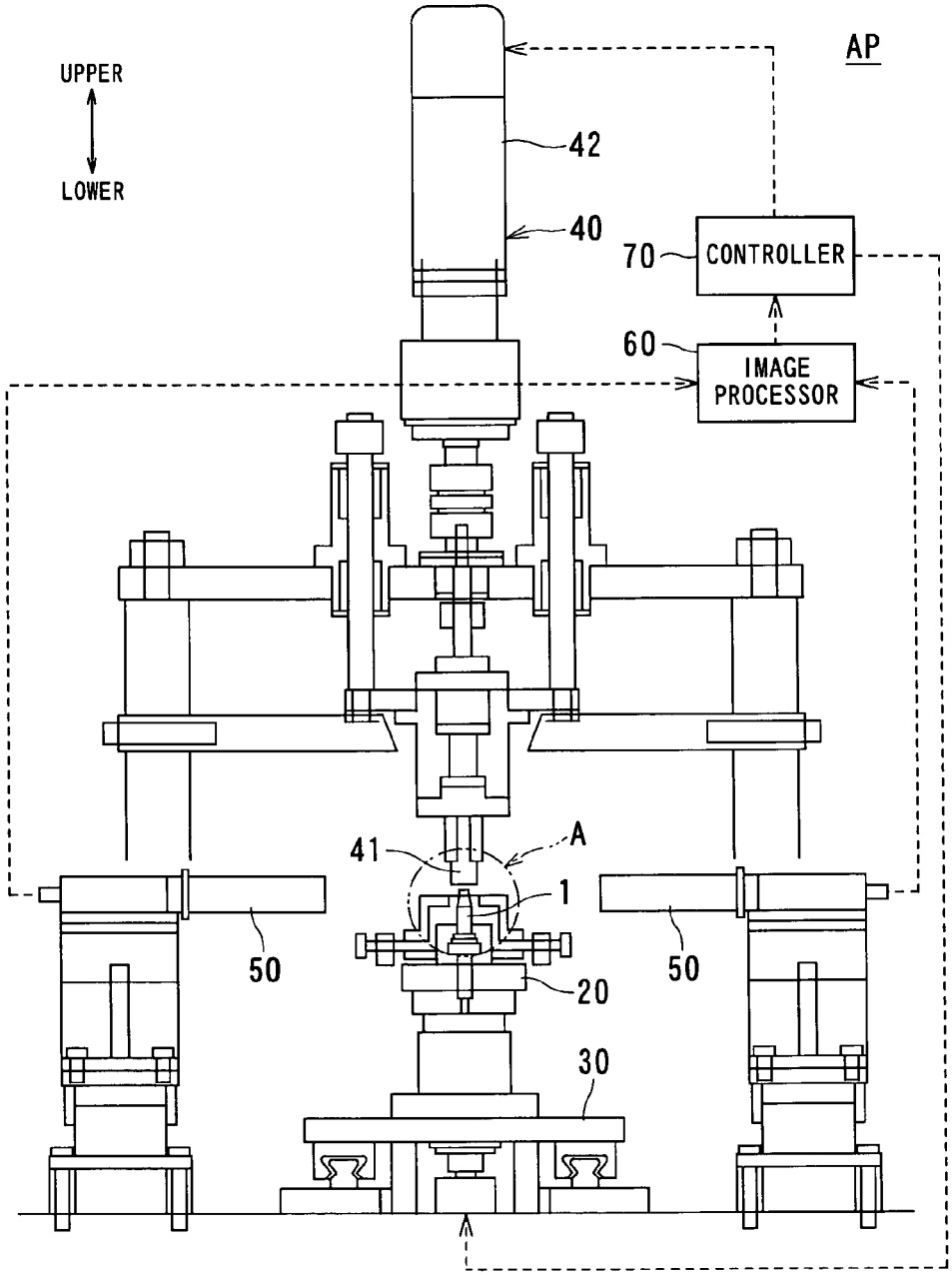
FIG. 1 illustrates the entire configuration of a manufacturing apparatus for spark plugs according to one example of the present invention.

In the present embodiment, a spark plug is manufactured by a manufacturing apparatus shown in FIG. 1. This manufacturing apparatus is provided with cameras, as will be described later, of which arrangement is pictorially shown in FIG. 2. A spark plug is manufactured through various processes including processes for bending an earth electrode of the spark plug, the bending processes being pictorially shown in FIGS. 3 and 4.

Prior to the explanation of the manufacturing processes for a spark plug 1, the spark plug 1 will now be explained in terms of its structure with reference to FIGS. 3 and 4.

Figure 3:
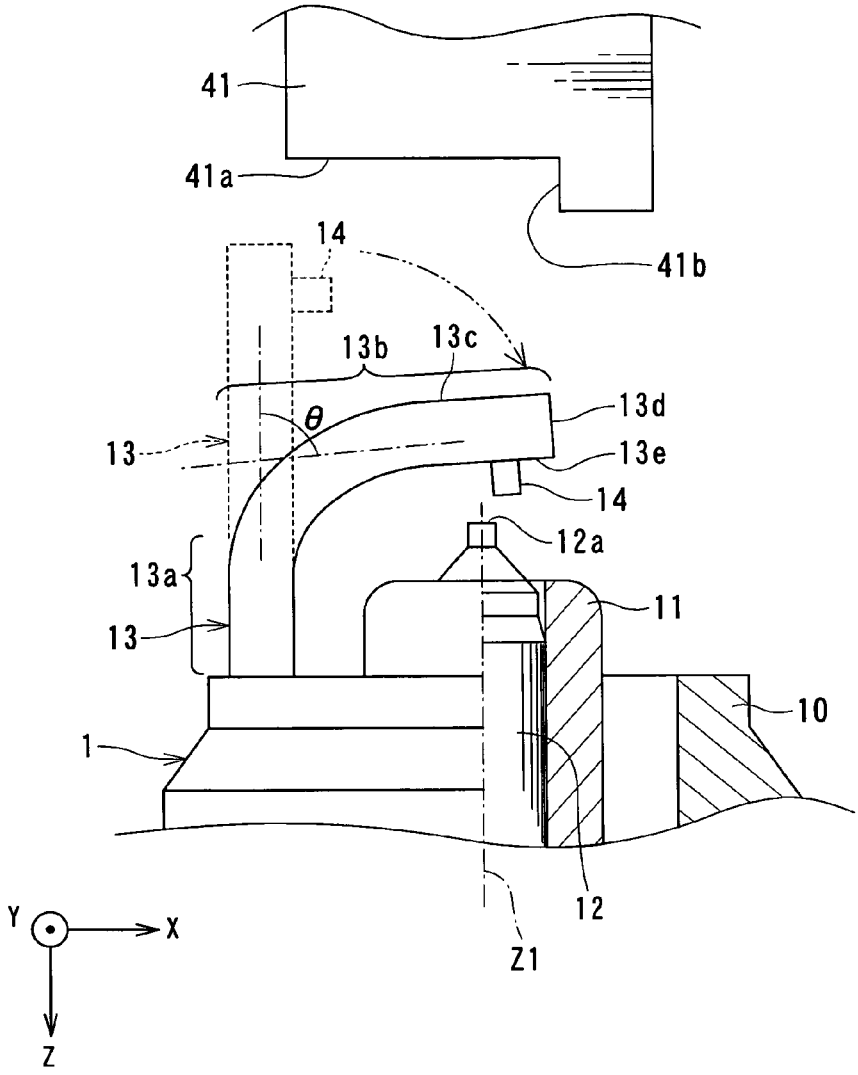
FIG. 3 is an enlarged view of an encircled area "A" in FIG. 1, the view showing an earth electrode that has been subjected to a provisional bending process.
Figure 4:
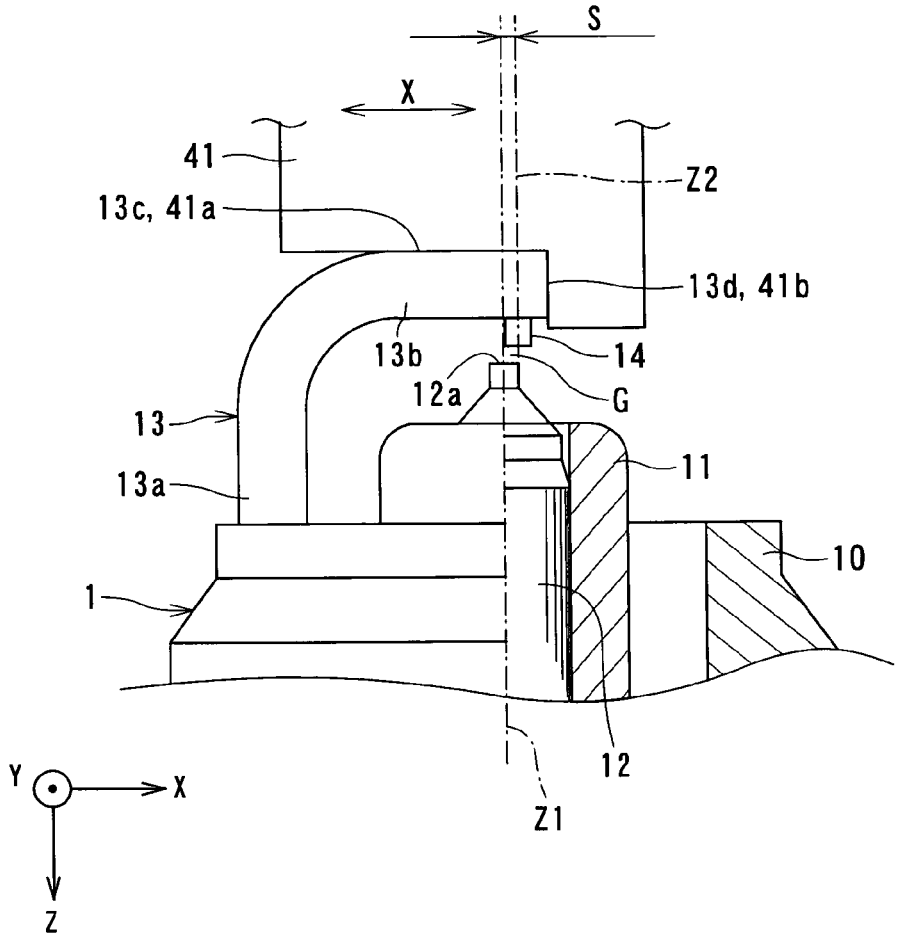
FIG. 4 is an enlarged view of an encircled area "A" in FIG. 1, the view showing the earth electrode during a main bending process.

As shown in FIGS. 3 and 4, the spark plug 1 has a housing 10, which is made of conductive steel material, is formed into a substantial cylindrical shape. A substantially cylindrical porcelain insulator 11, made of ceramic, which is highly insulative, is inserted and fixed in the housing 10, with its one end protruding from one end of the housing 11. An axial hole is formed in the porcelain insulator 11.

A center electrode 12, which is made of conductive metal and formed into a substantially cylindrical shape, is inserted and fixed in the axial hole of the porcelain insulator 11. A platy earth electrode 13 made of Ni (Nickel) based alloy is joined on one axial end of the housing 10. On end of the earth electrode 13, there is bonded a columnar noble metal chip 14 made of waste resistant material against spark, such as Ir (iridium) alloy.

Figure 2:
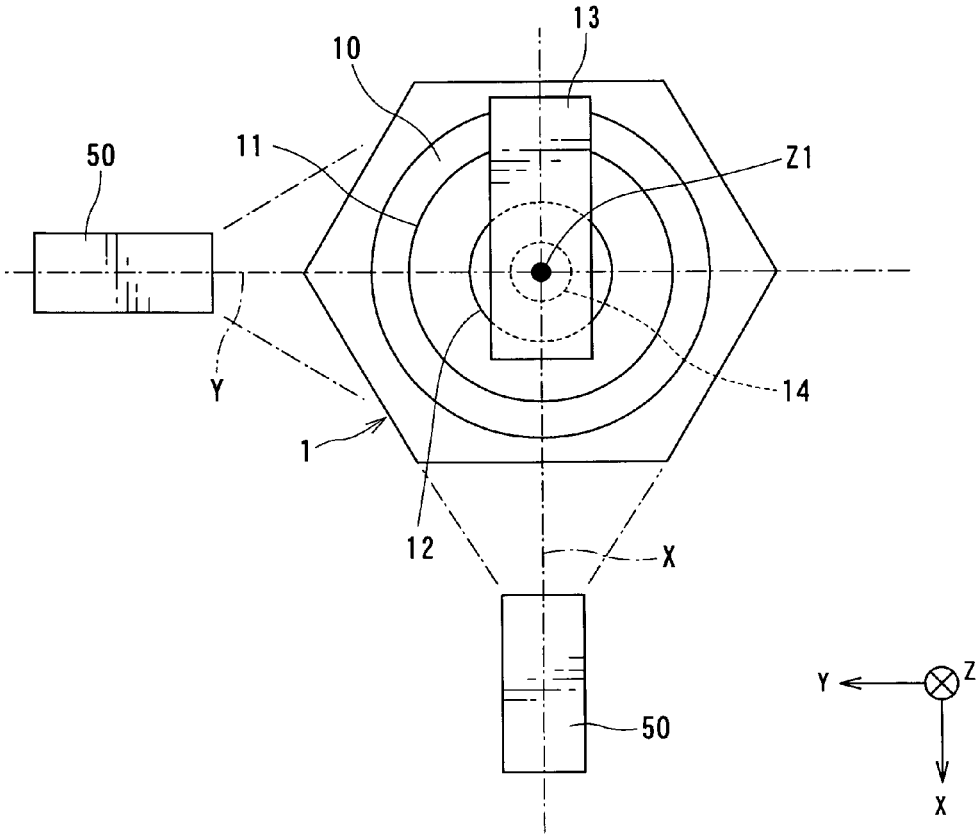
FIG. 2 is a plan view pictorially showing an arrangement of plural cameras to the apparatus, the cameras serving as imaging means.

In the present embodiment, for the sake of an easier understanding of the directions concerning the spark plug 1, the XYZ orthogonal coordinate system is introduced as shown in FIGS. 2–4, such that the axial (longitudinal or length-ward) direction of the center electrode 12 is assigned to the Z-axis direction.

During the production of the spark plug 1, the earth electrode 13 is subjected to two-stage bending processes consisting of a provisional bending process and a main bending process. The provisional bending process precedes the main bending one, so that the provisional bending process serves as a first bending process according to the present invention. The term "provisional" may be replaced by other equivalent terms "temporal" and "previous" to the term "provisional." Accordingly the main bending process is set to finally and finely bend the earth electrode so as to locate the noble metal chip in place. The main bending process therefore corresponds to a second bending process according to the present invention.

As shown by a dotted line in FIG. 3, the earth electrode 13 has a straight shape before the provisional bending process is carried out. Once the earth electrode 13 undergoes the provisional bending process, the electrode 13 is bent into a substantial L shape, as shown by a solid line in FIG. 3 in dotted line and solid line.

Then, the earth electrode 13 is further bent through the main bending process to form a spark gap G with a given length, as shown in FIG. 4.

When viewing the bent shape of the earth electrode 13, the earth electrode 13 is essentially composed of a straight base part 13*a* and a laterally bent end part 13*b* continuously extending from the straight base part 13*a*. That is, the straight base part 13*a* straight extending in the Z-axis direction substantially in parallel with an axial line Z1 axially passing the center electrode 12 (hereinafter referred to as "center electrode axial line Z1"). On the other hand, the laterally bent end part 13*b* that extends in the X-axis direction substantially perpendicular to the center electrode axial line Z1.

A noble metal chip 14 is bonded on one surface of the laterally bent end part 13*b* of the earth electrode 13 so that the chip 14 faces a tip surface 12*a* of one axial end of the center electrode 12. The spark gap G of a given length is thus formed between the noble metal tip 14 and the center electrode 12 in the direction along the center electrode axial line Z1.

Referring back to FIGS. 1 and 2, the spark plug manufacturing apparatus will now be explained.

The manufacturing apparatus AP is provided with mechanical components and electrical components.

As shown in FIG. 1, the manufacturing apparatus AP includes, as mechanical components, a holder 20 for fixing a work (i.e., spark plug 1) with the spark gap G kept upward, a holder driving unit 30 for moving the holder 20 in a first direction X (refer to FIGS. 2–4) perpendicular to the center electrode axial line Z1, and an earth electrode pressing unit 40 for pressing the earth electrode 13 to reduce a distance between the electrodes 12 and 13.

Further, as electrical components, the manufacturing apparatus AP is provided with two cameras 50 arranged on the side of the earth electrode pressing unit 40, an image processor 60 for processing image signals from the cameras 50 into an image, and a controller 70 for controlling the holder driving unit 30 and the earth electrode pressing unit 40 based on the signal from the image processor 60.

The earth electrode press unit 40 includes, for example, a bending punch 41 pressing the earth electrode 13 and a bending punch driving unit 42 shifting (i.e., upward and downward) the bending punch 41 along the direction of the center electrode axial line Z1. For instance, servo motors can be used for the bending punch driving unit 42 and the holder driving unit 30.

In the present embodiment, the bending punch driving unit 42 and the holder driving unit 30 correspond to a first driving means and a second driving means in the present invention, respectively.

As shown in FIGS. 3 and 4, the bending punch 41 has first and second pressing surfaces 41*a* and 41*b* that both form a step-like lower surface, in which the second pressing surface 41*b* is perpendicular to the first pressing surface 41*a*. Both of the first and second pressing surfaces 41*a* and 41*b* are jointly in charge of bending the earth electrode 13. The first pressing surface 41*a* is formed to fit to one end-side surface 13*c* (i.e., a second end-side surface) of the laterally bent end part 13*b*, the surface 13*c* being opposite to an end-side surface 13*e* (i.e., a first end-side surface) on which the noble metal chip 14 is joined. The surface 13*c* is thus referred to as "opposite-to-chip surface" in the present embodiment. The second pressing surface 41*b* is formed to fit to a tip surface 13*d* of the earth electrode 13. The first pressing surface 41*a* is positioned to be perpendicular to the center electrode axial line Z1, while the second pressing surface 41*b* is a surface extending in the direction in parallel with the center electrode axial line Z1.

The "opposite-to-chip surface" 13*c* corresponds to a second side surface of the second end of the earth electrode in the present invention.

As shown in FIG. 2, the two cameras 50 are arranged to image predetermined three-dimensional regions each including the electrodes 12 and 13 from two directions perpendicular to each other, after completing the provisional bending process for the earth electrode 13. The imaging direction of a first camera 50 is made to agree with the X-axis direction (refer to FIG. 2). The imaging direction of a second camera 50 is made to agree to the Y-axis direction perpendicular to both the center electrode axial line Z1 and the X-axis direction.

The image processor 60 is equipped with an interface and a universal image processing unit (not shown) with a computer system including a dedicated CPU (central processing unit) and some memories. Thus the image processor 60 operates on a predetermined software algorism which has been read out from a memory so that video signals from the cameras 50 are processed into images of a predetermined format. In addition, the image processor 60 analyzes the images to find out three-dimensional coordinates of the positions of both center electrode 12 and earth electrode 13.

The controller 70 is equipped with, by way of example, a programmable logic controller (PLC) and operates using signals from the image processor 60. Specifically, the controller 70 uses such signals to control both of the holder driving unit 30 and the bending punch driving unit 42, so that the operations of both holder 20 and bending punch 41 are controlled.

The bending processes of the earth electrode 13, which is carried out in the present embodiment, will now be described.

The bending processes according to the present embodiment consist essentially of three stages of i) the provisional bending process, ii) the main bending process, and iii) post correction processes. Since the present invention is mainly directed to the second and third stages, the provisional bending process will now be explained as below in a simplified manner.

<Provisional Bending Process>

At first, the spark plug 1 of which earth electrode 13 has not been bent is mounted to a not-shown provisional bending apparatus, so that the earth electrode 13 is provisionally bent, as shown by the solid line in FIG. 3. That is, the earth electrode 13 is bent at its predetermined length-directional position to form both of the straight base part 13*a* and the laterally bent end part 13*b*.

As a result of this provisional bending, the laterally bent end part 13*b* is bent at an angle of θ, which is almost 90 degrees, but less than 90 degrees, to the straight base part 13*a*. Hence the metal chip 14 is located above the tip 12*a* of the center electrode 12.

After the provisional bending, the spark plug 1 is located such that the longitudinal direction of the laterally bent end part 13*b* exactly agrees with the X-axis direction. The center and earth electrodes 12 and 13 are then subjected to imaging by not-shown imaging means, like cameras. Using the imaged results, it is examined whether or not there is a positional shift between the center electrode axial line Z1 and the axial line Z2 of the metal chip 14 (refer to FIG. 4; hereinafter referred to as "chip axial line Z2") in the Y-axis direction.

If such a positional shift is present, a not-shown correcting device works to correct the position of the laterally bent end part 13*b* in the Y-axis direction so that the positional shift is amended. In this state, the size of the spark gap G is set to a quantity slightly larger than a target size to be given after the main banding process for the earth electrode 13.

<Main Bending Process>

The spark plug 1, which has experienced the provisional bending as above, is then subjected to the main bending process.

Practically, the spark plug 1 is fixedly mounted on the holder 20 by manual handling operations or by using a not-shown handling device, with the plug tip having the spark gap G upward. In this mounting process, like the provisional bending process, the spark plug 1 is located such that the longitudinal direction of the laterally bent end part 13*b* exactly agrees with the X-axis direction.

Figure 5:
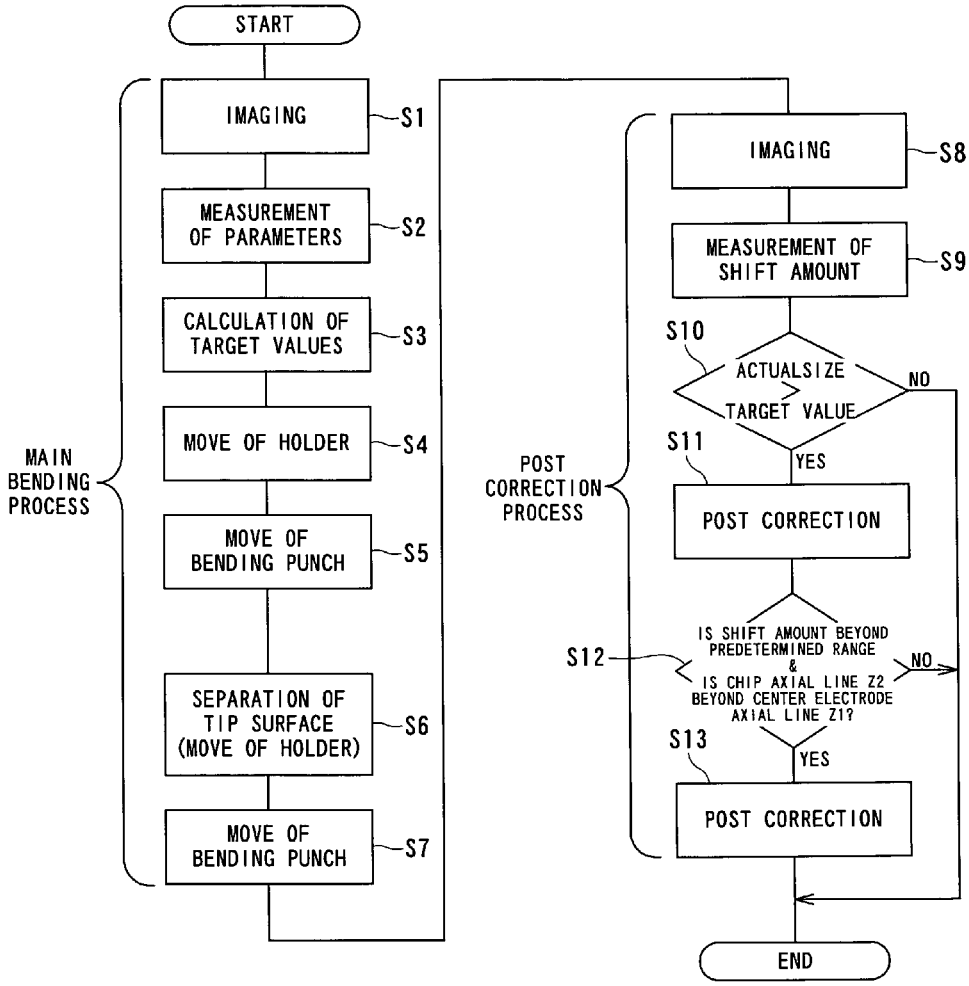
FIG. 5 is a flowchart outlining the processing for the main bending process, which is carried out by an image processor and a controller both installed in the manufacturing apparatus.

The two cameras 50 are then instructed to take images of predetermined regions each including the center and earth electrodes 12 and 13 of the spark plug 1 (i.e., work to be processed) (step S1 in FIG. 5). The resultant images are processed by the image processor 60 to measure amounts of various parameters (step S2). To be specific, data of the images taken by the cameras 50 is provided to the image processor 60, in which the image data are subjected to measurement of the amounts of the various parameters. These parameters include data indicative of the position of the tip 12*a* of the center electrode and a distance from the tip surface 13*d* of the earth electrode 13 to the chip axial line Z2 of the metal chip 14.

Then target values for moving the bending punch 41 and holder 20 are calculated by the image processor 60 (step S3). Practically, such target values are two in number in the present embodiment. One is a distance of the bending punch 41 toward (downward) the center electrode 12, which is necessary to make the size of the spark plug G equal to its target value, while the other is a position of the holder 20 in the X-axis direction. That is, the holder 20 is position-controlled together with the move of the bending punch 41 so as to finally adjust the chip position. The calculation of the target values may be carried out by the controller 70, not limited to the image processor 60.

The target position of the holder in the X-axis direction will now be more detailed. This target position is determined such that, after the main bending, a shift amount S between the center electrode axial line Z1 and the chip axial line Z2 in the X-axis direction falls within a predetermined tolerance range. This shift amount S is depicted in FIG. 4 and is hereinafter referred to as "X-directional shift amount." More practically, depending on the distance from the tip surface 13*a* of the earth electrode 13 to the chip axial line Z2, a target distance from the chip axial line Z2 to the second pressing surface 41*b* (shoulder portion) of the bending punch 41 in the X-axial direction is decided, and the X-directional position of the holder 20 is decided to meet the target distance.

After the above preparations, the holder 20 is moved in a controlled manner to meet the X-directional target position (step S4), and then the bending punch 41 is moved downward toward the center electrode 12 by an amount of the decided target distance (step S5).

To be specific, the controller 70 sends a control command to the bending punch driving unit 42 to move the bending punch 41 downward. This downward movement of the bending punch 41 causes its first pressing surface 41*a* to come in touch with the opposite-to-chip surface 13*c* of the earth electrode 13, and then to press the surface 13*c*. Hence the earth electrode comes nearer to the center electrode 12.

During this downward movement of the earth electrode 13, that is, the bending work, the tip surface 13*d* tries to move (extend) toward the second pressing surface 41*b* of the bending punch 41, as the earth electrode 13 presses downward. But such move is limited by the second pressing surface 41*b* serving as block means, so that a range in which the tip surface is allowed to move has a limitation.

The foregoing lateral and downward movements of the holder 20 and the bending punch 41 allow the bending punch 41 to slowly press the earth electrode 13 downward, thus realizing the distance between the tip position of the center electrode 12 and the metal chip 14 on the earth electrode 13, that is, the spark gap G, which is equal to the target value.

After pressing the earth electrode 13 downward by the bending punch 41, the bending punch 41 is controlled to move away from the earth electrode 13. In this move-way control, first of all, the holder 20 is driven to move in the X-axis direction so that the tip surface 13*d* of the earth electrode 13 is first laterally moved to separate from the second pressing surface 41*b* (i.e., a kind of lock means) of the bending punch 41 (step S6). After this lateral move, the bending punch 41 is finally moved upward so that the punch 41 steps away from the center electrode 12, before returning to the original position (step S7).

The reason that the above two-stage retreat technique is employed in this embodiment is as follows. In cases where the tip surface 13*d* is left as it touches the second pressing surface 41*b* when the bending punch 41 is returned to its original position, there is a fear that the upward pull-back move of the bending punch 41 drags the tip surface 13*d* of the earth electrode 13 in the upward direction. If such a drag occurs, the size of the spark plug G that has once met the target value is spoiled again.

In contrast, in the present embodiment, the earth electrode 13 is first moved to separate the tip surface 13*d* from the second pressing surface 41*b*, and then the bending punch 41 is pulled up. Hence the possibility that the above drag occurs is diminished, preventing the size of the spark plug G from being changed after the main bending.

<Post Correction process>

The earth electrode 13 that has undergone the foregoing main bending is then subjected to the post correction process for the earth electrode 13.

After the main bending, the two cameras 50 are again operated to image the predetermined regions each including both electrodes 12 and 13 (step S8). Like the foregoing, the shift amount S in the X-axis direction is measured and the size of the spark plug G is measured (step S9).

Then it is determined whether or not the actual size of the spark gap G is greater than the target value (step S10). If the determination is affirmative (i.e. the actual size of the spark gap G is greater than the target value), the bending punch 41 is again operated to press the earth electrode 13 in the same way as the above (step S11).

Further, it is determined, as shown in FIG. 4, whether or not the shift amount S in the X-axis direction is beyond the predetermined range and the chip axial line Z2 is shifted beyond the center electrode axial line Z1 toward the second pressing surface 421*b* of the bending punch 41 (step S12). If determination is YES, the following positional post correction is executed (step S13).

Namely, the bending punch 41 is moved downward until its second pressing surface 41*b* is located at the same level as that of the tip surface 13*d* of the earth electrode 13, and then the holder 20 is driven to move so that the tip surface 13*d* has a press from the second pressing surface 41*b*. This press operation allows the position of the metal chip 14 to be pulled back in the X-axis direction, so that the shift amount S can be reduced steadily.

In the present embodiment, as described above, the main bending process for the earth electrode 13 is carried out such that the X-axis directional target distance from the noble metal chip 14 to the second pressing surface 41*b* is decided, and its target distance is used to decide the X-axis directional target position of the holder 20. This manner assures that the bending punch 41, i.e., the first/second pressing surfaces 41*a* and 41*b* thereof, is well positioned toward the earth electrode 13. As a result, when the bending process of the earth electrode 13 is completed, the coaxiality between the center electrode 12 and the noble metal tip 14 is successfully increased in accuracy.

In addition, the X-axis directional position of the holder 20 is determined in response to the distance from the tip surface 13*d* of the earth electrode 13 to the tip axial line Z2 work by work. Accordingly, the coaxiality between the center electrode 12 and the noble metal tip 14 is improved after the main bending process of the earth electrode 13.

Moreover, if the shift amount S in the X-axis direction is beyond the predetermined tolerance range though the main bending process is completed, the holder 20 is again driven to cause the bending punch to correct the position of the earth electrode 13. That is, as the post processing, the X-axis directional relative distance between the noble metal chip 14 and the tip 12*a* of the center electrode 12 can be finely adjusted. This also assures that the accuracy in the coaxiality is raised steadily.

Since the bending punch 41 is made to return to the original position after separating the tip surface 13*d* of the earth electrode 13 from the second pressing surface 41*b* of the bending punch 41, the tip surface 13*d* will not be dragged when the bending punch 41 is returned to its original position. Accordingly, the spark gap G is prevented from being lowered in the accuracy of the size.

An additional advantage can be gained from use of the plural cameras 50, which increases accuracy in the measurement of positional information about the earth electrode, noble metal chip, and center electrode. This higher measurement accuracy is also reflected in creating the spark gap of higher dimension and coaxiality.

Other Embodiments

In the above embodiment, the bending punch 41 may be moved in the X-axis direction, instead of moving the holder 20 in the X-axis direction. In such a case, it is enough that the driving means moving the bending punch 41 in the X-axis direction is replaced by the second driving means in the present invention.

The present invention may be embodied in other specific forms without departing from the spirit or essential characteristics thereof. The present embodiment and modifications are therefore to be considered in all respects as illustrative and not restrictive, the scope of the present invention being indicated by the appended claims rather than by the foregoing description and all changes which come within the meaning and range of equivalency of the claims are therefore intended to be embraced therein.

What is claimed is:

1. A method for manufacturing a spark plug provided with a housing, a substantially cylindrical center electrode held in an insulated manner in the housing, an earth electrode having first and second axial end portions, one of said axial end portions being joined to the housing, and a noble metal chip joined on a first end-side surface of the other axial end portion of the earth electrode, comprising:

performing a provisional bending process wherein the spark plug is mounted to a holder and the earth electrode is bent from a condition in which the earth electrode is straight and in parallel with an axial line of the center electrode to a condition in which the other axial end portion of the earth electrode is located closer to a tip of the center electrode;

locating a bending punch having a first pressing surface and a second pressing surface perpendicular to the first pressing surface in such a manner that the first pressing surface is fitted to a second end-side surface located diametrically opposite to the first end-side surface of the earth electrode and the second pressing surface is fitted to a tip surface of the earth electrode, the tip surface connecting the first and second end-side surfaces;

first moving the bending punch so as to make the second pressing surface come into contact with the tip surface of the earth electrode; and second moving the bending punch, as a main bending process, so that the first pressing surface presses the second end-side surface downward toward the tip of the center electrode in the axial direction of the center electrode, the tip surface of the earth electrode being held by the second pressing surface during the second moving process, whereby the noble metal chip axially opposes the tip of the center electrode via a spark gap of a predetermined length.

2. The manufacturing method according to claim 1, further comprising:

deciding a target position of the second pressing surface of the bending punch in a direction perpendicular to the axial line of the center electrode on the base of a distance from the tip surface of the earth electrode to the noble metal chip, wherein the first moving step moves the bending punch so that the second pressing surface comes in contact with the tip surface of the earth electrode on the basis of the decided target position.

3. The manufacturing method according to claim 1, further comprising:

third moving at least one of the bending punch and the holder in a direction perpendicular to the axial line of the center electrode so as to separate the second pressing surface of the bending punch from the tip surface of the earth electrode after the main bending process is completed; and fourth moving the bending punch along the axial line of the center electrode after the third moving step.

4. The manufacturing method according to claim 1, further comprising:

measuring a coaxiality of the center electrode and the noble metal chip after the main bending process after the second moving process; and correcting a position of the noble metal chip in a direction perpendicular to the axial line of the center electrode on the basis of a result measured in the measuring step.

5. The manufacturing method according to claim 4, wherein the measuring step includes imaging a region including at least the other end of the earth electrode, the noble metal chip, and a tip of the center electrode and calculating the coaxiality using image data acquired during said imaging, the imaging being carried out in a plurality of directions each perpendicular to the axial line of the center electrode.

6. The manufacturing method according to claim 4, where the correcting step corrects the position of the noble metal chip in the direction perpendicular to the axial line of the center electrode by moving at least one of the bending punch and the holder so that the second pressing surface presses the tip surface in said perpendicular direction.

7. The manufacturing method according to claim 4, wherein in the provisional bending process, the earth electrode is bent to an angle of approximately 90 degrees, but less than 90 degrees.

8. The manufacturing method according to claim 1, wherein in the provisional bending process, the earth electrode is bent to an angle of approximately 90 degrees.

9. A method for manufacturing a spark plug provided with a housing, a substantially cylindrical center electrode held in the housing, an earth electrode having first and second ends in an axial direction thereof, one of said ends being joined to the housing, and a noble metal chip joined to a first end-side surface of the other end of the earth electrode, the manufacturing method comprising steps of:

disposing the spark plug in a manufacturing apparatus with a holder for holding the spark plug and a bending punch having a first pressing surface and a second pressing surface perpendicular to the first pressing surface;

performing a provisional bending process wherein the spark plug is mounted to the holder and the earth electrode is bent to locate the other end of the earth electrode locate closer to a tip of the center electrode;

disposing the bending punch so that the first pressing surface is fitted to a second end-side surface of the earth element located diametrically opposite to the first end-side surface of the earth electrode and so that the second pressing surface is fitted to a tip surface of the earth electrode, the tip surface connecting the first and second end-side surfaces;

first moving the bending punch so as to make the second pressing surface come in contact with the tip surface of the earth electrode; and second moving the bending punch, as a main bending process, so that the first pressing surface presses the second end-side surface downward toward the tip of the center electrode in the axial direction of the center electrode, the tip surface of the earth electrode being held by the second pressing surface during the second moving process, whereby the noble metal chip is made to axially oppose to the tip of the center electrode via a spark gap of a predetermined length.

10. The manufacturing method according to claim 9, wherein in the provisional bending process, the earth electrode is bent to an angle of approximately 90 degrees, but less than 90 degrees.

11. The manufacturing method according to claim 9, further comprising steps of:

measuring a coaxiality between the center electrode and the noble metal chip after the main bending process after the second moving process; and correcting a position of the noble metal chip in a direction perpendicular to the axial line of the center electrode on the basis of a result measured in the measuring step.

12. A method for manufacturing a spark plug provided with a housing, a substantially cylindrical center electrode is held in a insulated manner in the housing, an earth electrode having both ends one of which is joined to the housing, and a noble metal chip joined on a first end-side surface of the other end of the earth electrode, comprising:

providing the spark plug in a condition in which the earth electrode is bent through a provisional bending process so that the other end of the earth electrode is located closer to a tip of the center electrode than a condition in which the earth electrode is straight and in parallel with an axial line of the center electrode, the provided spark plug being mounted to a holder;

setting a bending punch having a first pressing surface to be fitted to a second end-side surface located back-to-back to the first end-side surface and a second pressing surface to be fitted to a tip surface connecting the first and second end-side surfaces;

moving the bending punch so that the second pressing surface comes in contact with the tip surface of the earth electrode;

second moving the bending punch so that the first pressing surface presses the second end-side surface in the axial direction of the center electrode, whereby a main bending process is performed to coaxially make the noble metal chip oppose to the tip of the center electrode via a spark gap of a predetermined length;

third moving at least one of the bending punch and the holder in a direction perpendicular to the axial line of the center electrode so as to separate the second pressing surface of the bending punch from the tip surface of the earth electrode after the main bending process; and fourth moving the bending punch along the axial line of the center electrode after the third moving step.

* * * * *